United States Patent [19]

Cooper

[11] 3,991,832

[45] Nov. 16, 1976

[54] HYDRAULICALLY TILTABLE AND ANGLABLE DOZER BLADE AND MOUNTING THEREFOR

[75] Inventor: Phillip Clinton Cooper, Holy Cross, Iowa

[73] Assignee: Deere & Company, Moline, Ill.

[22] Filed: July 14, 1975

[21] Appl. No.: 595,272

[52] U.S. Cl. ..... 172/804; 91/178; 91/401; 91/412

[51] Int. Cl.[2] ..... E02F 3/76; E02F 3/85

[58] Field of Search ..... 172/2, 4.5, 801, 803, 172/804, 805, 806, 807, 808, 809; 91/178, 186, 401, 412; 60/426, 427

[56] References Cited

UNITED STATES PATENTS

| | | | |
|---|---|---|---|
| 2,185,015 | 12/1939 | Low | 91/412 X |
| 3,142,962 | 8/1964 | Lohbauer | 60/427 X |
| 3,311,026 | 3/1967 | Crisp | 91/401 |
| 3,623,321 | 11/1971 | Schwerin | 60/426 X |
| 3,628,558 | 12/1971 | Bahl | 91/412 X |
| 3,631,930 | 1/1972 | Peterson | 172/804 |
| 3,657,969 | 4/1972 | Wirkus | 91/412 |
| 3,922,954 | 12/1975 | Gustafsson et al. | 91/412 |
| 3,942,413 | 3/1976 | Schwary et al. | 91/412 |

FOREIGN PATENTS OR APPLICATIONS

| | | | |
|---|---|---|---|
| 1,125,999 | 7/1956 | France | 91/401 |
| 293,948 | 1/1971 | U.S.S.R. | 172/809 |

*Primary Examiner*—Richard T. Stouffer

[57] ABSTRACT

Mounted between a frame and a dozer blade at opposite sides of vertically spaced stabilizing and ball joint connections joining the frame and blade are a pair of hydraulic angling actuators which are operative to angle the blade about a vertical axis defined by the connections. A hydraulic tilt actuator is connected between the frame and blade in the vicinity of the stabilizing connection and is operative to tilt the blade about a fore-and-aft axis passing through the ball joint connection. Pressure relief circuitry including a normally closed relief valve is connected to the angling actuator and the relief valve is opened in response to a predetermined pressure build-up in the angling actuators, as occasioned by changes in the location of the points of connection of the angling actuators with the blade during tilting of the latter, to exhaust fluid from the angling actuators to permit extension or retraction thereof. Poppet valving is provided in the pistons of the angling actuators for interconnecting opposite ends of each of the angling actuators when the latter are at the ends of their respective strokes so as to prevent the pressure from building up in the angling actuators when the blade is tilted.

3 Claims, 8 Drawing Figures

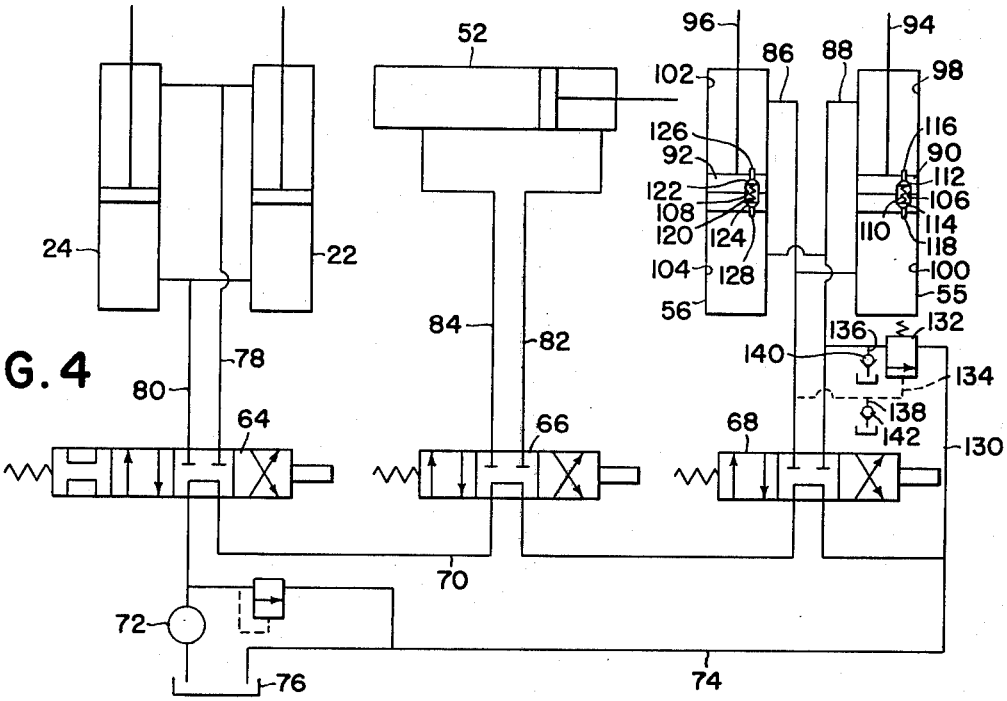
FIG. 4
FIG. 5
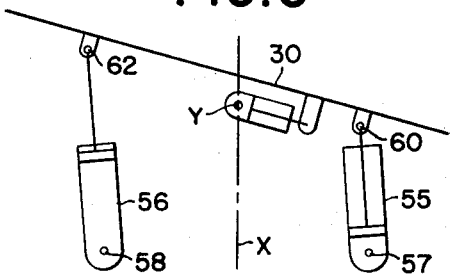
FIG. 7
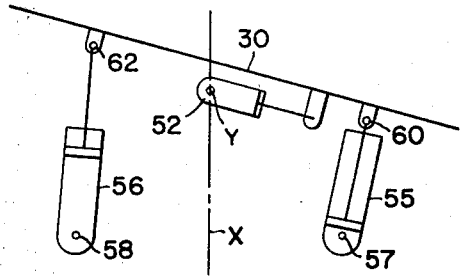
FIG. 6
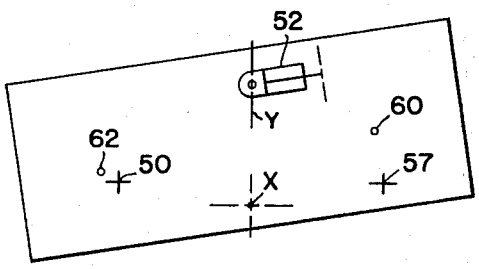
FIG. 8
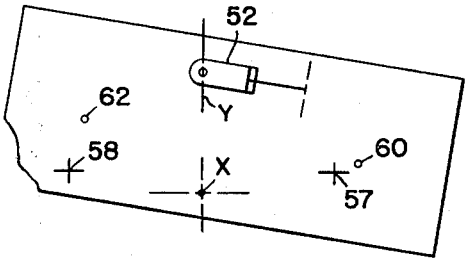

HYDRAULICALLY TILTABLE AND ANGLABLE DOZER BLADE AND MOUNTING THEREFOR

BACKGROUND OF THE INVENTION

The present invention relates to a dozer blade assembly and more particularly relates to a blade mounting and a blade actuating means which cooperate for selective angling and tilting of the blade.

Dozer blade assemblies are commonly constructed so as to include a blade connected to a central front part of a C-frame by means of a universal connection located midway between opposite ends of the blade. A pair of hydraulic angling actuators are often respectively connected between opposite legs of the C-frame and the blade and are actuatable to angle the blade about a vertical axis passing through the universal connection, and a hydraulic tilting actuator is connected between the front part of the frame and the blade and is actuatable to tilt the blade about a fore-and-aft axis passing through the universal connection.

These known dozer blade assemblies fail to operate in a satisfactory manner since either no provision at all is made for compensating for the changes in location of the points of connection of the angling actuators with the blade during tilting of the latter resulting in high forces being induced in the angling actuators which sometimes cause the blade to bind at its points of connection with the C-frame, or the blade is connected to the frame such that it will undergo a pitch change to compensate for the changes in location of the points of connection of the angling actuators with the blade during tilting of the latter, such a pitch change sometimes being unsuited for the work being performed. Further, the angling actuator of these known assemblies are sometimes hydraulically connected such that high pressures are generated therein when working loads are imposed on the corner of the blade.

SUMMARY OF THE INVENTION

According to the present invention there is provided a novel blade assembly structured such that mounting means and actuating means of and for the blade cooperate for efficient and effective tilting and angling of the blade.

A broad object of the invention is to provide a mounting means and actuating means which cooperate such that loads which might tend to bind tilting movement of the blade are prevented from being developed in the blade assembly.

A more specific object is to provide a mounting means and an actuating means, as described in the foregoing paragraph, wherein the actuating means includes pressure relief circuitry embodying valve means automatically operated to exhaust fluid from the angling actuators so as to allow angling of the blade during tilting of the latter so as to compensate for the change of the positions of the points of connection of the angling actuators with the blade when the latter is tilted.

Still a more specific object is to provide a normally closed relief valve which is actuated in response to a predetermined pressured being developed in the angling actuators by operation of the tilt actuator but is connected to the angling actuators so as not to be affected by pressure developed in the angling actuators by working loads imposed on the blade.

Another object is to provide valve means in the pistons of the angling actuators for interconnecting opposite ends of each of the actuators together so as to prevent a pressure build-up therein during tilting of the blade when the angling actuators are in respective bottomed conditions.

Yet another object of the invention is to provide a mounting means and an actuating means which cooperate to maintain the blade at a constant pitch during angling and tilting of the blade.

Another object is to provide angling actuators which are hydraulically coupled so as to minimize circuit pressures induced by working loads imposed on one corner of the blade.

These and other objects will become apparent from a reading of the ensuing description in conjunction with the appended drawings.

BRIEF DESCRIPTION OF THE DRAWINGS

FIG. 4 is a schematic representation of the hydraulic actuators and circuitry therefor for controlling the blade assembly.

FIG. 5 is a schematic top plan view of the angling actuators, the tilting actuator and the dozer blade with the right and left angling actuators being respectively retracted and extended within an inch of the ends of their strokes and holding the blade in a rightwardly angled position and with the tilting actuator being retracted and holding the blade in a counterclockwise tilted position.

FIG. 6 is a rear elevational view of the blade and actuator shown in FIG. 5 but with the angling actuators removed so as to expose their connection points with the blade.

FIG. 7 is a view similar to FIG. 5 but showing the tilting actuator extended and holding the blade in a clockwise tilted position.

FIG. 8 is a rear elevational view of the blade and actuators shown in FIG. 7 but with the angling actuators removed so as to expose their connection points with the blade.

DESCRIPTION OF THE PREFERRED EMBODIMENT

Figure 1:
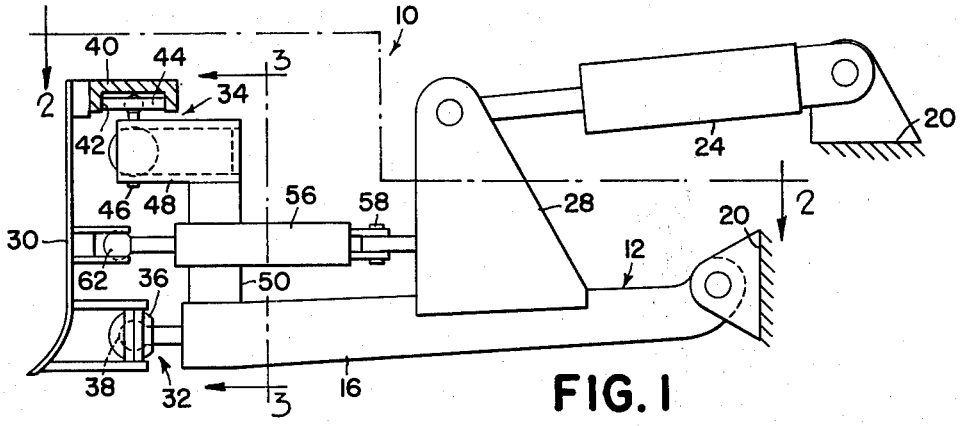
FIG. 1 is a somewhat schematic side elevational view of the dozer blade assembly of the present invention with a part of the stabilizer connection broken away to expose other parts thereof.
Figure 2:
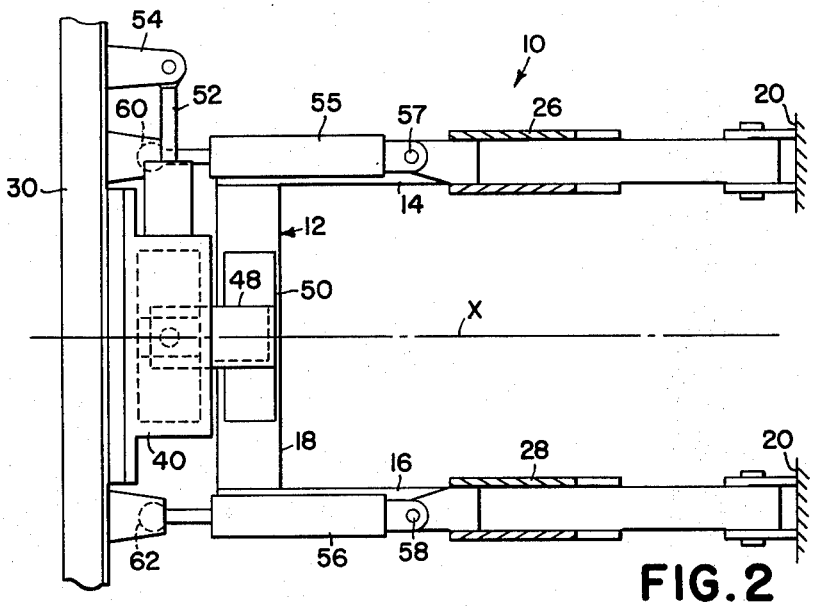
FIG. 2 is a sectional view taken along the line 2—2 of FIG. 1.
Figure 3:
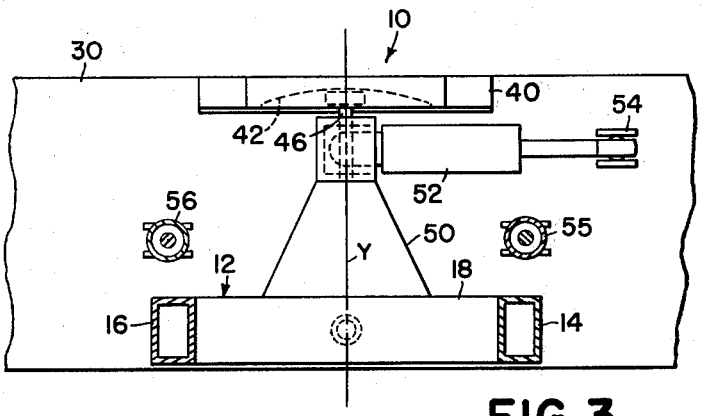
FIG. 3 is a sectional view taken along the line 3—3 of FIG. 1.

Referring now to FIGS. 1–3, therein is shown a dozer blade assembly indicated in its entirety by the reference numeral 10. The blade assembly 10 includes a support frame 12 of a type commonly called a C-frame and defined by right and left side members 14 and 16 (FIG. 3), respectively, having their forward ends joined by a transverse member 18 and having their rearward ends pivotally connected to tractor framework schematically shown at 20. Conventionally, the frame 12 would be disposed with its sides 14 and 16 along opposite sides of and with the member 18 just forwardly of a forward end portion (not shown) of a tractor. The frame 12 is swung vertically about its connection with the framework 20 through selective actuation of right and left hydraulic lift actuators 22 and 24, respectively, connected between the framework 20 and right and left upstanding members 26 and 28 respectively fixed to the tops of the sides 14 and 16 of the support frame 12.

A dozer blade 30 is joined to the transverse member 18 of the frame 12 through means including a lower ball joint connection 32 and an upper stabilizing connection 34. The ball joint connection 32 includes a ball receptacle 36 fixed to a lower central backside portion of the blade 30 and receiving a ball 38, which is fixed to the transverse member 18 at a central location thereof. The stabilizing connection 34 includes a member 40 fixed to the backside of the blade 30 at an upper central location thereof and defining an inverted U-shaped guide channel or track 42 which is curved arcuately at a fixed radius about a horizontal axis X extending longitudinally in the direction of travel of the blade 30 and passing centrally through the ball 38 of the connection 32. Disposed in the channel 42 is a slide block 44 swivelly mounted on one end of a vertical pin 46 fixed in a forwardly projecting portion 48 of an upstanding support post 50 fixed to a central topside portion of the transverse member 18. The pin 46 is located along a vertical axis Y which passes centrally through the ball 38 of the connection 32. Thus, it will be appreciated that the blade 30 is mounted for respectively tilting and angling about the axes X and Y.

It is here noted that the forward projecting portion 48 of the support post 50 could be made telescopic for the purpose of adjusting the pitch of the blade 30 with bolts or a hydraulic pitch actuator or the like being provided for fixing the portion 48 in a fixed adjusted length.

In FIGS. 1–3, the blade 30 is shown in an unangled condition wherein it extends perpendicular to the axis X and an untilted condition wherein it is horizontally disposed. For the purpose of selectively tilting the blade 30 about the axis X, there is provided a hydraulic tilting actuator 52 having its head end connected to the portion 48 of the support post 50 by the pin 46 and having its rod end connected to an ear 54 fixed to the backside of the blade 30.

For the purpose of selectively angling the blade 30 about the axis Y, there are provided right and left hydraulic angling actuators 55 and 56, respectively, having their respctive head ends coupled to the upstanding members 26 and 28, as at 57 and 58, and their respective rod ends pivotally connected to the backside of the blade 30 at connections 60 and 62.

Referring now to FIG. 4, therein is shown the hydraulic circuitry in which the blade actuators are embodied. Specifically, the hydraulic circuitry includes three manually operable open center direction control valves 64, 66 and 68 connected in parallel in a pressure line 70 having one end connected to a pump 72 and having another end connected to a return line 74. The pump 72 and the return line 74 are both in fluid communication with a sump or reservoir 76. The rod ends of both lift actuators 22 and 24 are connected to the control valve 64 by a control line 78 and the head ends of both left actuators 22 and 24 are connected to the valve 64 by a control line 80. The rod and head ends of the tilting actuator 52 are connected to the control valve 66 respectively through means of control lines 82 and 84. The head end of the angling actuator 55 and the rod end of the angling actuator 56 are connected to the control valve 68 by a control line 86 while the rod end of the actuator 55 and the head end of the actuator 56 are connected to the valve 68 by a control line 88. This cross connection of the head and rod ends of the actuators 55 and 56 has the advantage that only about one-half as much pressure is developed in the circuitry due to loads imposed on one end of the blade 30 as would be developed if the rod ends of the actuators 55 and 56 were connected together and the head ends of the actuators 55 and 56 were connected together.

The connections 60 and 62 which join the rod ends of the angling actuators 55 and 56 to the blade 30 move with the blade 30 when the latter is tilted about the axis X and it will be appreciated that provision must be made to compensate for this movement of the connections 60 and 62 if the blade 30 is to tilt without binding at the connections 32 and 34 and for without undue pressure being developed in the actuators 55 and 56. Such provision is made according to the present invention by incorporating features in the angling actuators 55 and 56 and in the circuitry just described.

Specifically, the angling actuators 55 and 56 respectively include pistons 90 and 92 fixed to respective first ends of piston rods 94 and 96. The piston 90 of the actuator 55 divides the cylinder thereof into rod and head end chambers 98 and 100 and the piston 92 of the actuator 56 divides the cylinder thereof into rod and head end chambers 102 and 104. Extending through the pistons 90 and 92 are respective passages 106 and 108. A coil compression spring 110 is located in the passage 106 and acts oppositely against poppet valve elements 112 and 114 to maintain the valve elements 112 and 114 in normally seated conditions wherein respective stem portions 116 and 118 thereof extend into the rod and head end chambers 98 and 100 for engagement with the opposite ends of the cylinder of the actuator 55 for unseating the valve elements 112 and 114 respectively when the actuator 55 becomes fully retracted and extended. Similarly, a coil compression spring 120 is located in the passage 108 and bears against poppet valve elements 122 and 124 at its opposite ends to maintain the valve elements 122 and 124 in normally seated conditions wherein respective stem portions 126 and 128 thereof extend into the rod and head end chambers 102 and 104 for engagement with the opposite ends of the cylinder of the actuator 56 for unseating the valve elements 122 and 124 respectively when the actuator 56 becomes fully retracted and extended. The purpose for the valve elements 112 and 114, and 122 and 124 will be presently described.

Returning now to the circuitry shown in FIG. 4, there is shown a pressure relief circuit including a relief line 130 which connects the control line 88 to the sump 76 and contains a normally closed, pressure relief valve 132 which is pilot operated in response to a predetermined pressure in the control line 86, the latter being connected to the valve 132 by a pilot pressure line 134. The sump 76 is respectively connected to the relief line 130, upstream from the valve 132 and to the pilot pressure line 134 by make-up fluid line 136 and 138 which respectively contain check valves 140 and 142 for permitting flow only from the sump 76.

The operation of the dozer blade assembly 10 is as follows: Assuming the blade 30 to be disposed as illustrated in FIGS. 5 and 6, the tilting actuator 52 will be retracted and the angling actuators 55 and 56 will be in respective retracted and extended conditions wherein the respective pistons thereof are approximately one inch from stroke extremes.

If it is then desired to tilt the blade 30 clockwise about the axis X, as viewed in FIG. 6, towards the position shown in FIG. 8, the control valve 66 is shifted rightwardly from its neutral position shown in FIG. 4 so as to connect the pump 72 and sump 76 respectively to the head and rod ends of the tilting actuator 52 to effect extension of the latter. As the blade 30 begins to tilt, the connections 60 and 62 of the angling actuation 55 and 56 with the blade 30 will respectively begin to move with the blade 30 downwardly and outwardly and upwardly and inwardly relative to the axis X. However, since the angling actuators 55 and 56 are at this point pressure locked in a fixed length, the movement of the blade 30 will act in a direction tending to forcibly contract or collapse the actuators 55 and 56. This results in an increase in the pressure in the respective head end and rod end chambers of each of the actuators 55 and 56. When the pressure, developed in the line 86 by the blade tending to collapse the right actuator 55, reaches the predetermined level necessary to operate the pressure relief valve 132, the valve 132 will open permitting pressurized fluid from the head end chamber 104 of the left actuator 56 to go to the sump 76 via the control line 88 and relief line 130. As the fluid from the chamber 104 is relieved to sump, the left actuator 56 will contract to thus allow the fluid from the head end chamber 100 of the right actuator 55 to flow into the rod end chamber 102 of the actuator 56 and allow the actuator 55 to contract. In this manner the actuators 55 and 56 are forcibly contracted.

It will be appreciated then that when the blade 30 is tilted from its FIG. 8 position to its FIG. 6 position the actuators 55 and 56 will be forcibly extended. This will induce a vacuum in the head end of actuators 55 and 56. Makeup fluid will then enter the head ends of actuators 55 and 56 through the check valves 140 and 142, thus eliminating hydraulic cavitation in actuators 55 and 56.

Assuming the blade 30 to be in a fully rightwardly angled position just beyond that shown in FIG. 5, the angling actuators 55 and 56 will respectively be fully retracted and fully extended and the poppet valve element 114 of the actuator 55 and the poppet valve element 124 of the actuator 56 will be unseated due to their respective stem portions 118 and 126 being respectively engaged with the head end of the actuator 55 and the rod end of the actuator 56.

If it is then desired to tilt the blade 30 clockwise about the axis X, as view in FIG. 5, the tilting actuator 52 is actuated, in the manner previously described, to cause it to extend. As the blade 30 begins to tilt, the connections 60 and 62 of the actuators 55 and 56 with the blade 30 will respectively begin to move downwardly and outwardly and upwardly and inwardly with the blade 30. As described before, the tilting movement of the blade 30 will cause an increase in the pressure in the respective head end chamber 104 of the actuator 56 and rod end chamber 98 of actuator 55. This pressure rises to a predetermined point where poppet valves 116 and 128 are hydraulically unseated allowing fluid to pass by the mechanically unseated poppet valves 118 and 126, thus interconnecting hydraulically the head and rod ends of actuators 55 and 56.

As the pressure rises sufficiently to operate the relief valve 132, as occasioned by further tilting of the blade, pressure fluid will flow from the head end chamber 104 of actuator 56 to the return line 130 either via a path through the line 88, poppets 116 and 114, line 86 and the relief valve 132 or via a path through the poppets 124 and 126, the line 86 and the relief valve 132. In either case, the actuator 56 is forcibly contracted as occasioned by the tilting actuator 52.

It is to be noted that during operation pressure developed in the angling actuators 55 and 56 due to engaging the blade 30 with an item or substance to be dozed will not be effective to cause extension or retraction of the actuators 55 and 56. For example, if the force resisting movement of the blade 30 is distributed evenly over the length of the blade, no pressure will be developed in the actuators 55 and 56 due to the control lines 86 and 88 being cross connected between the opposite ends of the actuators 55 and 56. If the blade is for example, loaded more to the left than it is to the right of the axis Y, the pressure in the rod and head ends respectively of the actuators 55 and 56 might raise to that sufficient to open the relief valve 132 but no fluid would pass therethrough since no pressure would be developed in the head and rod ends respectively of the actuators 55 and 56.

I claim:

1. In a combination including first and second two-day hydraulic angling actuators connected between a dozer blade and a frame to which the blade is connected by universal connection means located between the actuators and by stabilizing connection means for guiding the blade during angling and tilting movements of the latter about the universal connection means, a two-way hydraulic tilting actuator connected between the blade and frame, a first conduit means connected between a first direction control valve and a head-end work port of the first actuator and a rod-end work port of the second actuator, a second conduit means connected between the control valve and a rod-end work port of the first actuator and a head-end work port of the second actuator, third and fourth conduit means respectively connected between a second control valve and head and rod-end work ports of the tilting actuator, each of a source of fluid pressure and a reservoir connected to the first and second control valves, the improvement comprising: a pilot pressure conduit means and a reservoir connected pressure relief conduit means respectively connected to one and another of said first and second conduit means; a normally closed, pressure responsive relief valve means located in said pressure relief conduit means and connected to said pilot pressure conduit means and responsive to a predetermined pressure in the latter to assume an open condition whereby pressure induced in said angling actuators by actuation of said tilting actuator will be kept at a value no greater than said predetermined pressure by operation of said bypass valve means.

2. The combination set forth in claim 1 and further including first and second pressure and position responsive poppet valve means respectively embodied in the first and second actuators for respectively establishing fluid communication between the head and rod-end work ports of the first actuator when the latter is bottomed and a second predetermined pressure is present therein, and establishing fluid communication between the head and rod-end work ports of the second actuator when the latter is bottomed and said second predetermined pressure is present therein.

3. In a combination including first and second double-acting hydraulic actuators mounted between a support frame and a dozer blade in an orientation conducive for angling the blade about a universal connection means located between the actuators and connecting the blade to the frame, a third double-acting hydraulic actuator mounted between the support frame and the dozer blade in an orientation conducive for tilting the blade about the universal connection, stabilizing connecting means coupling the blade to the frame for guided movement about the universal connection, each actuator including rod and head-end work ports, first and second conduit means respectively interconnecting the rod-end work port of the first actuator and the head-end work port of the second actuator, and interconnecting the head-end work port of the first actuator and the rod-end work port of the second actuator, third and fourth conduit means respectively connected to the rod and head-end work ports of the third actuator, pressure and exhaust conduit means respectively connected to a source of fluid pressure and a reservoir, first and second direction valve each connected to the source of fluid pressure and the reservoir and respectively connected to the first and second conduit means and to the third and fourth conduit means, the improvement comprising: a pilot pressure conduit means and a reservoir-connected pressure relief conduit means respectively connected to one and the other of said first and second conduit means; a normally closed, pressure responsive relief valve means located in said pressure relief conduit means and connected to said pilot pressure conduit means and responsive to a predetermined pressure therein to move to an open position, whereby pressure induced in said first and second actuators by actuation of said third actuator will be kept at a value no greater than said predetermined pressure by operation of said bypass valve means.

* * * * *